US007822366B2

(12) United States Patent
Jeon et al.

(10) Patent No.: US 7,822,366 B2
(45) Date of Patent: Oct. 26, 2010

(54) IMAGE FORMING APPARATUS AND DEVELOPING UNIT THEREOF

(75) Inventors: In Cheol Jeon, Yongin-si (KR); Jong Pil Jun, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 12/189,356

(22) Filed: Aug. 11, 2008

(65) Prior Publication Data

US 2009/0214262 A1 Aug. 27, 2009

(30) Foreign Application Priority Data

Feb. 21, 2008 (KR) ..... 10-2008-0015802

(51) Int. Cl.
*G03G 15/01* (2006.01)

(52) U.S. Cl. ..... 399/223; 399/258

(58) Field of Classification Search ..... 399/223
See application file for complete search history.

(56) References Cited

U.S. PATENT DOCUMENTS

2001/0021322 A1 9/2001 Tsuruya et al.
2004/0184838 A1 9/2004 Ikeda et al.
2005/0281591 A1* 12/2005 Kitozaki et al. ..... 399/258
2006/0093409 A1 5/2006 Kyung
2006/0275680 A1* 12/2006 Miyakawa ..... 430/45

FOREIGN PATENT DOCUMENTS

JP 01131583 5/1989
JP 2005-189901 7/2005
JP 2007121555 5/2007

OTHER PUBLICATIONS

European Search Report issued Apr. 15, 2009 in EP Application No. 09150143.7.
Russian Decision on Grant issued Mar. 10, 2010 in RU Application No. 2008135872/09.

* cited by examiner

*Primary Examiner*—David M Gray
*Assistant Examiner*—Roy Yi
(74) *Attorney, Agent, or Firm*—Stanzione & Kim LLP

(57) ABSTRACT

An image forming apparatus to enhance a user's convenience by adequately designing developer storage capacities of developing devices in consideration of an amount of consumed developer includes an image carrier, and plural developing devices arranged along a rotational direction of the image carrier to supply a developer to the image carrier. The plural developing devices include a first developing device having a largest developer storage capacity, and a second developing device disposed in a most downstream side with respect to the rotational direction of the image carrier. The second developing device has a second largest developer storage capacity.

22 Claims, 4 Drawing Sheets

IMAGE FORMING APPARATUS AND DEVELOPING UNIT THEREOF

CROSS-REFERENCE TO RELATED APPLICATIONS

This application claims priority under 35 U.S.C. §119(a) from Korean Patent Application No. 2008-0015802, filed on Feb. 21, 2008 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an image forming apparatus having plural developing devices to supply a developer to an image carrier.

2. Description of the Related Art

An image forming apparatus refers to an apparatus that prints an image on a printing medium according to an input image signal. An image forming apparatus is classified as a printer, a copying machine, a fax machine, a multi-function printer which has multiple functions of printing, scanning, copying and faxing, and the like.

As one type of the image forming apparatus, an electrophotographic type image forming apparatus is operated such that light is scanned to a photosensitive body charged to a predetermined electric potential to form an electrostatic latent image on a surface of the photosensitive body and a developer is supplied to the electrostatic latent image to form a visible developer image. The developer image formed on the photosensitive body is directly transferred onto a printing medium, or is transferred onto a printing medium via an intermediate transfer body. The image transferred onto the printing medium is fused to the printing medium through a fusing process.

In the printing operation, the developer image on the photosensitive body or the intermediate transfer body is not totally transferred onto the intermediate transfer body or the printing medium. A portion of the developer remains on the photosensitive body or the intermediate transfer body. Such residual waste developer is removed by a cleaning device, and is stored in a waste developer storage container.

Generally, a cleaning device includes a cleaning blade which is contacted with a surface of an image carrier such as the photosensitive body or the intermediate transfer body with a predetermined pressure. One end portion of the cleaning blade makes friction with the surface of the image carrier, so as to rake out the residual developer on the surface of the image carrier.

If an appropriate amount of developer remains on the surface of the image carrier, a problem does not exist. However, if an inappropriate amount of developer exists on the surface of the image carrier, for example, when the image forming apparatus is warmed up, or if only an inappropriately small amount of developer remains on the surface of the image carrier because a printing medium having a good transfer efficiency is used, a high frictional force is exerted between the cleaning blade and the image carrier, which may create a problem such that the cleaning blade is turned over.

Even if the cleaning blade does not become turned over, an excessive high frictional force between the image carrier and the cleaning blade may cause damage to the image carrier or the cleaning blade or may generate friction noise.

In order to solve the above problems, a method for reducing friction between the image carrier and the cleaning blade is used, which is as follows: an image for lubrication is formed on the image carrier at a predetermined point of time, for example, when the image forming apparatus is warmed up, or at an interval from the printing of one page to the printing of a next page in a successive printing operation.

However, when the above conventional method is applied to a color image forming apparatus having plural developing devices, the following problems may occur.

Generally, a color image forming apparatus includes four developing devices for respective colors. Any one of four developing devices serves to carry out the printing operation of forming an image on a printing medium, and to supply a developer to an image carrier during the operation of forming an image for lubrication on the image carrier. The developing device used in the lubricating operation has a relatively higher consumption of developer than the other developing devices, and accordingly should be replaced more often than other developing devices. Therefore, a user has an inconvenience of frequently replacing the specific developing device, and further if a user does not have a deep knowledge about the operational principle of the image forming apparatus, a user may distrust the quality of the product.

Also, the color image forming apparatus is operated such that until an image for lubrication formed on the image carrier passes by all of the developing devices arranged in a downstream side of the image carrier, the next printing operation cannot be performed. Thus, a printing speed in the successive printing operation is deteriorated.

Further, while an image for lubrication formed on the image carrier passes by the developing devices arranged in a downstream side of the image carrier, the image for lubrication may be moved to the developing devices, and may contaminate the developing devices, which causes deterioration of image quality at the next printing operation.

SUMMARY OF THE INVENTION

The present general inventive concept provides an image forming apparatus and a developing unit thereof, to enhance a user's convenience by adequately designing developer storage capacities of developing devices in consideration of an amount of consumed developer.

The general inventive concept also provides an image forming apparatus and a developing unit thereof, to prevent reduction of a printing speed or contamination of developing devices due to an image for lubrication formed on an image carrier.

Additional aspects and/or utilities of the general inventive concept will be set forth in part in the description which follows and, in part, will be obvious from the description, or may be learned by practice of the general inventive concept.

The foregoing and/or other aspects and utilities of the general inventive concept may be achieved by providing an image forming apparatus including an image carrier, and plural developing devices arranged along a rotational direction of the image carrier to supply a developer to the image carrier. The plural developing devices include a first developing device having a largest developer storage capacity, and a second developing device disposed in a most downstream side with respect to the rotational direction of the image carrier and having a developer storage capacity smaller than the developer storage capacity of the first developing device and larger than a developer storage capacity of remaining developing devices.

The image forming apparatus may further include a cleaning unit to remove a residual developer on the image carrier by making friction with the image carrier. The second developing device may supply a developer to the image carrier to reduce friction between the image carrier and the cleaning unit.

The image forming apparatus may further include a laser scanning unit to scan light to the image carrier. The laser scanning unit may form an electrostatic latent image for lubrication on a surface of the image carrier, and the second developing device may supply a developer to the electrostatic latent image for lubrication.

The developing devices may be arranged parallel and adjacent to each other.

The image carrier may include a photosensitive body having a surface on which an electrostatic latent image and a developer image are formed.

The plural developing devices may respectively include photosensitive bodies having respective surfaces on which electrostatic latent images and developer images are formed, and the image carrier may include an intermediate transfer body to hold a developer image transferred from the respective photosensitive bodies.

The first developing device may store a black developer, and the second developing device may store a yellow developer.

The foregoing and/or other aspects and utilities of the general inventive concept may also be achieved by providing an image forming apparatus including a photosensitive body, a laser scanning unit to form an electrostatic latent image by scanning light to the photosensitive body, and plural developing devices arranged along a rotational direction of the photosensitive body. The plural developing devices include a first developing device including a first developer storage portion having a first volume, a second developing device including a second developer storage portion having a second volume smaller than the first volume, and at least one third developing device including a third developer storage portion having a third volume smaller than the second volume. The second developing device is disposed in a most downstream side with respect to the rotational direction of the photosensitive body.

The first developing device, the second developing device and the at least one third developing device may be arranged parallel and adjacent to each other.

The image forming apparatus may further include a cleaning unit to remove a residual developer on the photosensitive body by making friction with the photosensitive body. The laser scanning unit may form an electrostatic latent image for lubrication on the photosensitive body, and the second developing device may supply a developer to the electrostatic latent image for lubrication to form a developer image for lubrication, so as to reduce friction between the photosensitive body and the cleaning unit.

The image forming apparatus may further include an intermediate transfer belt to hold an image transferred from the photosensitive body, and a cleaning unit to remove a residual developer on the intermediate transfer belt by making friction with the intermediate transfer belt.

The foregoing and/or other aspects and utilities of the general inventive concept may also be achieved by providing an image forming apparatus including plural developing devices respectively including photosensitive bodies and supplying developers to the respective photosensitive bodies, a laser scanning unit to form electrostatic latent images by scanning light to the respective photosensitive bodies, and an intermediate transfer body to hold images transferred from the photosensitive bodies. The plural developing devices include a first developing device including a first developer storage portion having a first volume, a second developing device including a developer storage portion having a second volume smaller than the first volume, and at least one third developing device including a third developer storage portion having a third volume smaller than the second volume. The second developing device is disposed in a most downstream side with respect to a rotational direction of the intermediate transfer body.

The first developing device, the second developing device and the at least one third developing device may be arranged parallel and adjacent to each other along the rotational direction of the intermediate transfer body.

The image forming apparatus may further include a cleaning unit to remove a residual developer on the intermediate transfer body by making friction with the intermediate transfer body. The laser scanning unit may form an electrostatic latent image for lubrication on the photosensitive body of the second developing device, and the second developing device may supply a developer to the electrostatic latent image for lubrication to form a developer image for lubrication, so as to reduce friction between the intermediate transfer body and the cleaning unit.

The foregoing and/or other aspects and utilities of the general inventive concept may also be achieved by providing a developing unit usable with an image forming apparatus to supply a developer to a rotating image carrier, the developing unit including plural developing devices arranged parallel and adjacent to each other along a rotational direction of the image carrier. The plural developing devices include a first developing device having a largest first developer storage capacity, and a second developing device disposed in a most downstream side with respect to the rotational direction of the image carrier and having a second developer storage capacity smaller than the first developer storage capacity of the first developing device and larger than respective developer storage capacities of remaining developing devices.

The foregoing and/or other aspects and utilities of the general inventive concept may also be achieved by providing a developing device usable with an image forming apparatus, the developing device including a developer storage portion to store and supply a developer of a first color to the image carrier and having a developer storage capacity smaller than a first developer storage capacity of a first developing device provided to supply a black developer to the image carrier and larger than a second developer storage portion of a second developing device provided to supply a developer of a second color to the image carrier, wherein the developing device is disposed in a most downstream side of developing devices arranged parallel and adjacent to each other along a rotational direction of an image carrier.

The foregoing and/or other aspects and utilities of the general inventive concept may also be achieved by providing a developing device usable with an image forming apparatus, the developing device including a developer storage portion to store a black developer, and is disposed in an upper stream side than a first developing device of the developing devices arranged parallel and adjacent to each other along a rotational direction of an image carrier, the first developing device provided to supply a developer of a first color to the image carrier, and the developing device having a developer storage capacity larger than a second developer storage capacity of a second developing device disposed in a most downstream side along the rotational direction of the image carrier, the second developer storage capacity of the second developing device being larger than the first developer storage capacity of the first developing device.

The foregoing and/or other aspects and utilities of the general inventive concept may also be achieved by providing a developing device usable with an image forming apparatus, the developing device including a developer storage capacity smaller than a first developer storage capacity of a first developing device of developing devices arranged parallel and adjacent to each other along a rotational direction of an image carrier, the first developing device being provided to supply a black developer to the image carrier, and smaller than a second developer storage capacity of a second developing device disposed in a most downstream side along the rotational direction of the image carrier, wherein the developing device is disposed between the first developing device and the second developing device along the rotational direction of the image carrier.

The foregoing and/or other aspects and utilities of the general inventive concept may also be achieved by providing an image forming apparatus including a photosensitive body to receive an electrostatic latent image, a laser scanning unit to form the electrostatic latent image on the photosensitive body, a cleaning unit to remove a residual developer on the photosensitive body; and a plurality of developer devices having respective developer storage capacities, one of the developer devices to supply a developer to the electrostatic latent image to form a developer image for lubrication to reduce friction between the photosensitive body and the cleaning unit, wherein a respective developer storage capacity of the one developer device is greater than an other respective storage capacity of at least one of an other developer device.

A respective developer storage capacity of the one developer device may be greater than an other respective storage capacity of at least one of an other developer device.

The foregoing and/or other aspects and utilities of the general inventive concept may also be achieved by providing an image forming apparatus including an image carrier, and a plurality of developing devices arranged along a portion of the image carrier, a developing device among the plurality of developing devices which is furthest downstream of a rotation direction of the image carrier having a larger storage capacity than other ones of the plurality of developing devices, wherein the developing device furthest downstream of the rotation direction of the image carrier contains a developer which provides a lubrication to the image carrier.

The developing device furthest downstream of the rotation direction of the image carrier may contain a developer which provides a lubrication to the image carrier.

The one developer device may store yellow developer.

A developer device among the plurality of developing devices which is furthest upstream of the rotation direction of the image carrier may have a larger storage capacity than the developing device furthest downstream of the rotation direction of the image carrier to store a most commonly used developer without developers stored in the other developing devices.

BRIEF DESCRIPTION OF THE DRAWINGS

These and/or other aspects and utilities of the exemplary embodiments of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
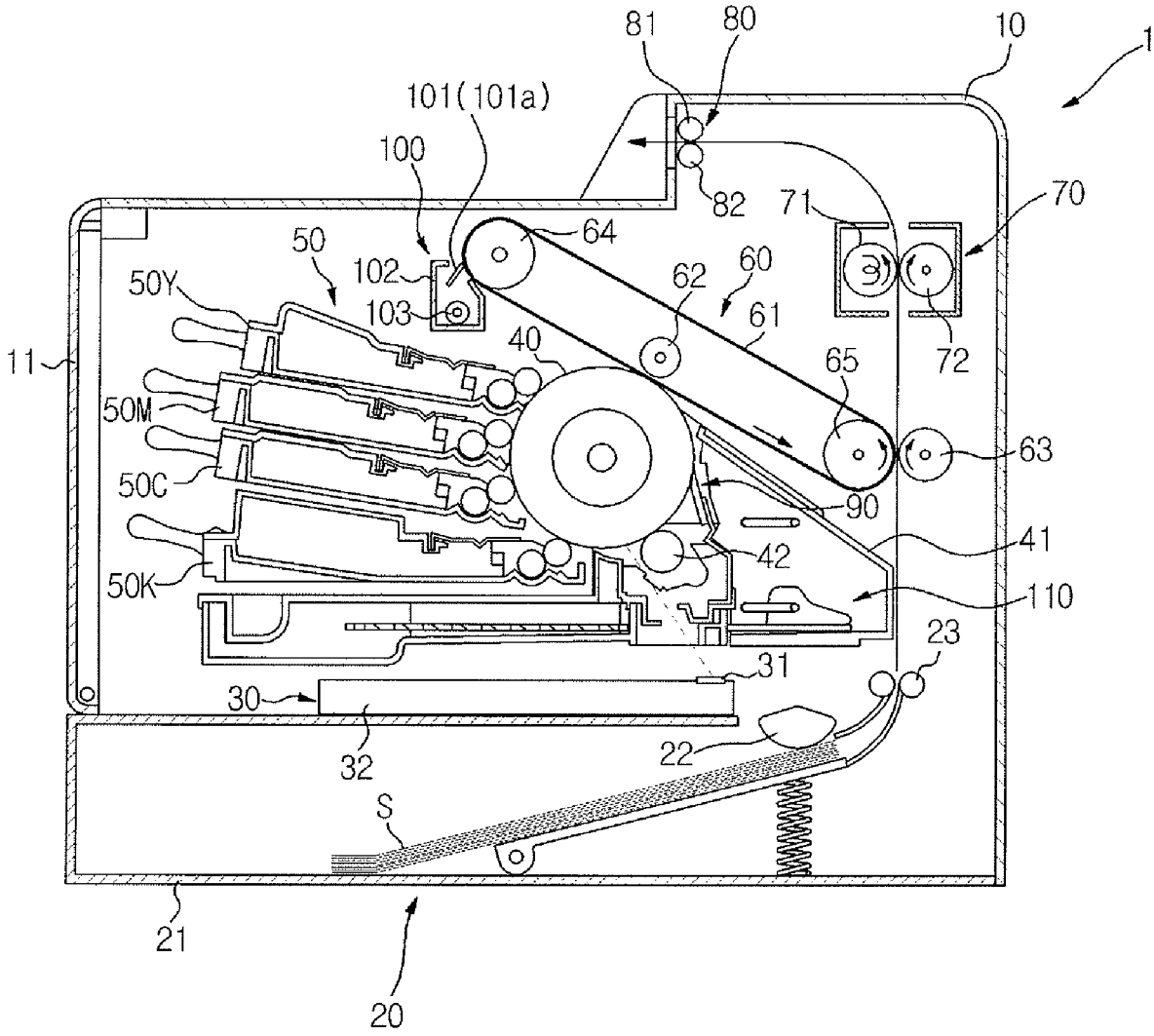
FIG. 1 is a view illustrating an image forming apparatus according to an exemplary embodiment of the present general inventive concept.

Reference will now be made in detail to exemplary embodiments of the present general inventive concept, examples of which are illustrated in the accompanying drawings, wherein like reference numerals refer to like elements throughout. The embodiments are described below to explain the present general inventive concept by referring to the figures.

Figure 2:
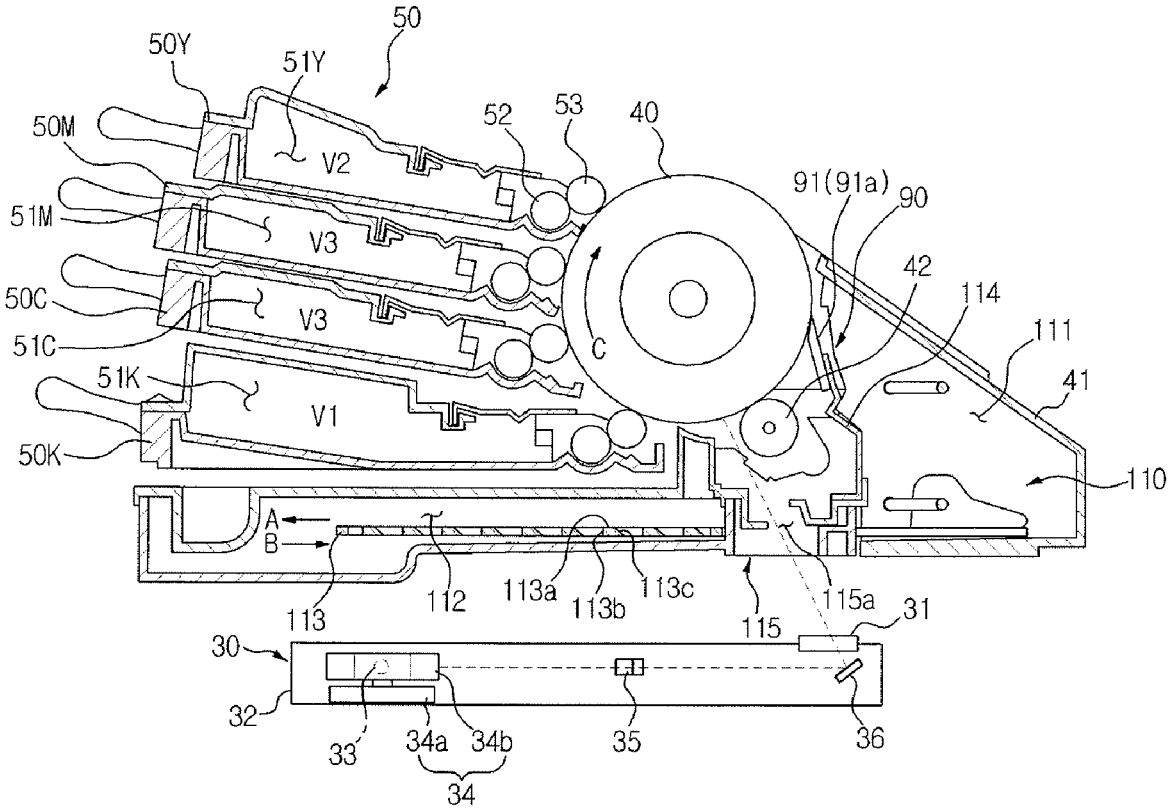
FIG. 2 is a view illustrating a partial constitution of the image forming apparatus illustrated in FIG. 1.

FIG. 1 is a view illustrating an image forming apparatus according to an exemplary embodiment of the present general inventive concept, and FIG. 2 is a view illustrating a partial constitution of the image forming apparatus illustrated in FIG. 1.

As illustrated in FIGS. 1 and 2, an image forming apparatus 1 includes a main body 10, a printing medium feeding unit 20, a laser scanning unit 30, a photosensitive body 40, a developing unit 50, a transfer unit 60, a fusing unit 70 and a printing medium discharge unit 80.

The main body 10 forms an exterior appearance of the image forming apparatus 1, and supports components mounted thereinside. A cover 11 is hingedly coupled to the main body 10 to expose or shield an opened portion of the main body 10. A user can get access to the interior of the main body 10 by opening the cover 11, and can mount or demount the components, such as the developing unit 50, in/from the main body 10.

The printing medium feeding unit 20 includes a cassette 21 to store a printing medium S, a pickup roller 22 to pick up the printing medium S in the cassette 21 sheet by sheet, and a feeding roller 23 to feed the picked-up printing medium S toward the transfer unit 60.

The laser scanning unit 30 serves to form an electrostatic latent image by scanning light to the photosensitive body 40. While the image forming apparatus 1 performs a printing operation, the laser scanning unit 30 scans light corresponding to image information to the photosensitive body 40. Also, while the image forming apparatus 1 performs an operation of lubricating the photosensitive body 40 and the transfer unit 60, the laser scanning unit 30 forms an electrostatic latent image for lubrication on the photosensitive body 40. The electrostatic latent image for lubrication may be formed in a band shape along an axial direction of the photosensitive body 40.

The laser scanning unit 30 includes a case 32 having a light-transmitting member 31 so that light can be irradiated outside, and a scanning optical system mounted in the case 32.

Referring to FIGS. 1 and 2, the scanning optical system includes a light source 33 to emit light, an optical deflector 34 to deflect the light emitted from the light source 33, an f-theta (fθ) lens 35 to correct aberration included in the light deflected from the optical deflector 34, and a mirror 36 to reflect the light passing through the f-theta lens 35 toward the photosensitive body 40.

The optical deflector 34 includes a driving motor 34*a*, and a polygon mirror 34*b* which is rotated by the driving motor 34*a*. The polygon mirror 34*b* has plural reflecting surfaces at a side portion to deflection-scan the light incident from the light source 33.

The light emitted from the light source 33 is deflected by the rotating polygon mirror 34*b*, and is reflected toward the light-transmitting member 31 by the mirror 36 via the f-theta lens 35. The light reflected from the mirror 36 passes through the light-transmitting member 31, and is irradiated to the outside of the case 32. Then, the light is transmitted to the photosensitive body 40, and forms an electrostatic latent image on a surface of the photosensitive body 40.

The photosensitive body 40 serves as an image carrier to hold an electrostatic latent image formed by the laser scanning unit 30 and a developer image formed by the developing unit 50.

The photosensitive body 40 is rotatably mounted in a photosensitive body housing 41 which is removably mounted in the main body 10. A charging roller 42 is mounted in the photosensitive body housing 41. The photosensitive body 40 is charged to a predetermined electric potential by the charging roller 42 before the laser scanning unit 30 scans light to the photosensitive body 40.

The developing unit 50 serves to supply a developer to the photosensitive body 40, on which an electrostatic latent image is formed, to form a visible developer image. The developing unit 50 includes four developing devices 50K, 50C, 50M and 50Y, in which developers of different colors from each other, e.g., black (K), cyan (C), magenta (M) and yellow (Y), are respectively stored. Hereinafter, when it is required to explain the four developing devices 50K, 50C, 50M and 50Y individually, the developing device 50K will be referred to as a black developing device, the developing device 50C will be referred to as a cyan developing device, the developing device 50M will be referred to as a magenta developing device, and the developing device 50Y will be referred to as a yellow developing device.

The developing devices 50K, 50C, 50M and 50Y are arranged parallel and adjacent to each other along a rotational direction ("C" direction) of the photosensitive body 40. As illustrated in FIG. 2 that the black developing device 50K, the cyan developing device 50C, the magenta developing device 50M and the yellow developing device 50Y are arranged in order along the rotational direction of the photosensitive body 40, however the developing devices 50K, 50C, 50M and 50Y are not necessarily arranged in the above-described order. The arrangement order of the developing devices 50K, 50C, 50M and 50Y may be changed as needed.

The respective developing devices 50K, 50C, 50M and 50Y include developer storage portions 51K, 51C, 51M and 51Y, supply rollers 52 and developing rollers 53. In FIG. 2, for convenience of explanation, only the supply roller and the developing roller mounted in the developing device 50Y are denoted by the reference numerals 52 and 53.

The developer storage portions 51K, 51C, 51M and 51Y store developers to be supplied to the photosensitive body 40. The supply rollers 52 supply the developers stored in the developer storage portions 51K, 51C, 51M and 51Y to the developing rollers 53. The developing rollers 53 attach the developers to the surface of the photosensitive body 40, on which an electrostatic latent image is formed, to form a visible image.

Basically, the developing devices 50K, 50C, 50M and 50Y supply the developers to the photosensitive body 40 to form a developer image, when the image forming apparatus 1 prints an image on the printing medium. Also when the image forming apparatus 1 performs the lubricating operation, one of the developing devices 50K, 50C, 50M and 50Y, which is disposed in the most downstream side with respect to the rotational direction of the photosensitive body 40, supplies the developer to the photosensitive body 40 to form a developer image for lubrication.

If the developing device positioned in the most downstream side with respect to the rotational direction of the photosensitive body 40 is used to form the developer image for lubrication, the developing devices 50K, 50C, 50M and 50Y can be operated to start the printing operation immediately after the developer image for lubrication is formed on the photosensitive body 40. Therefore, reduction of printing speed in a successive printing operation can be prevented. Further, the developer image for lubrication formed on the photosensitive body 40 is prevented from contaminating the developing rollers 53 while the developer image passes by the developing devices 50K, 50C, 50M and 50Y.

The black developing device 50K is provided to have the largest developer storage capacity of any developing device. The developing device positioned in the most downstream side with respect to the rotational direction of the photosensitive body 40, i.e., the yellow developing device 50Y has the second largest developer storage capacity.

That is, the developer storage portion 51K of the black developing device 50K is formed to have a first volume V1, and the developer storage portion 51Y of the yellow developing device 50Y positioned in the most downstream side with respect to the rotational direction of the photosensitive body 40 is formed to have a second volume V2 smaller than the first volume V1. The developer storage portions 51C and 51M of the remaining developing devices 50C and 50M are formed to have a third volume V3 smaller than the second volume V2.

The reason to form the black developing device 50K to have the largest developer storage capacity is based on that the black developer is most consumed because only the black developer is used in the black and white printing operation.

The reason to form the yellow developing device 50Y positioned in the most downstream side with respect to the rotational direction of the photosensitive body 40 to have the second largest developer storage capacity is based on an amount of consumed developer when the image forming apparatus performs the lubricating operation. That is, the yellow developing device 50Y can store a larger amount of developer than the cyan developing device 50C and the magenta developing device 50M.

This embodiment illustrates that the developing device positioned in the most downstream side with respect to the rotational direction of the photosensitive body 40 is the yellow developing device 50Y, however the magenta developing device 50M or the cyan developing device 50C may be disposed in the most downstream side with respect to the rotational direction of the photosensitive body 40 as needed.

The transfer unit 60 includes an intermediate transfer belt 61, a first transfer roller 62 and a second transfer roller 63.

The intermediate transfer belt 61 is supported by support rollers 64 and 65, and runs at a same velocity as a linear velocity of the photosensitive body 40. The first transfer roller 62 opposes the photosensitive body 40 while the intermediate transfer belt 61 is interposed between the first transfer roller 62 and the photosensitive body 40, and transfers the developer image formed on the photosensitive body 40 onto the intermediate transfer belt 61.

The second transfer roller 63 opposes the support roller 65 while the intermediate transfer belt 61 is interposed between the second transfer roller 63 and the support roller 65. While the image is transferred onto the intermediate transfer belt 61 from the photosensitive body 40, the second transfer roller 63 is spaced apart from the intermediate transfer belt 61. When the image is completely transferred onto the intermediate transfer belt 61 from the photosensitive body 40, the second transfer roller 63 comes into contact with the intermediate transfer belt 61 with a predetermined pressure. When the second transfer roller 63 is contacted with the intermediate transfer belt 61, the image on the intermediate transfer belt 61 is transferred onto the printing medium.

When the image forming apparatus 1 performs the lubricating operation, the second transfer roller 63 is spaced apart from the intermediate transfer belt 61. Therefore, the developer image for lubrication transferred onto the intermediate transfer belt 61 from the photosensitive body 40 passes by the second transfer roller 63 without contact with the second transfer roller 63, and is removed by a cleaning device, which will be described later.

As illustrated in FIGS. 1 and 2, the image forming apparatus 1 includes a first cleaning device 90 to clean a residual developer on the photosensitive body 40, a second cleaning device 100 to clean a residual developer on the intermediate transfer belt 61, and a waste developer storage device 110 to store a waste developer collected from the photosensitive body 40.

The first cleaning device 90 includes a cleaning unit 91 disposed while contacting the photosensitive body 40. The cleaning unit 91 makes friction with the photosensitive body 40 to rake out the residual developer on the surface of the photosensitive body 40. The cleaning unit 91 may be configured as a cleaning blade 91*a*, which is mounted in the photosensitive body housing 41 and one end portion of which is contacted with the photosensitive body 40.

The second cleaning device 100 includes a cleaning unit 101 disposed while contacting the intermediate transfer belt 61, a waste developer collecting container 102 to temporarily store waste developer collected from the intermediate transfer belt 61 by the cleaning unit 101, and a conveying unit 103 to convey the waste developer collected in the waste developer collecting container 102.

The cleaning unit 101 may be configured as a cleaning blade 101*a*, one end portion of which makes friction with the intermediate transfer belt 61 to rake out the residual developer on the surface of the intermediate transfer belt 61. The conveying unit 103 may be configured as an auger, which has a helical-shaped blade and conveys the waste developer by rotation thereof.

FIGS. 1 and 2 illustrates that the cleaning units 91 and 101 are configured as the cleaning blades 91*a* and 101*a*, however the cleaning units 91 and 101 may be formed in a brush type or a roller type.

The waste developer storage device 110 includes a first waste developer storage portion 111, a second waste developer storage portion 112 and a waste developer conveying member 113.

The first waste developer storage portion 111 and the second waste developer storage portion 112 are provided in the photosensitive body housing 41. A support member 114 is mounted in a portion of the first waste developer storage portion 111, and the cleaning blade 91*a* is fixed to an end portion of the support member 114. The waste developer removed from the photosensitive body 40 by the cleaning blade 91*a* is stored in the first waste developer storage portion 111, and is conveyed to the second waste developer storage portion 112 by the waste developer conveying member 113.

A light window 115 is provided between the first waste developer storage portion 111 and the second waste developer storage portion 112. The light window 115 has a light-transmitting hole 115*a* formed through the photosensitive body housing 41. The light scanned from the laser scanning unit 30 penetrates the photosensitive body housing 41 through the light-transmitting hole 115*a*, and reaches the photosensitive body 40.

A developer path (not illustrated) is provided between the first waste developer storage portion 111 and the second waste developer storage portion 112. The developer stored in the first waste developer storage portion 111 makes a detour to avoid the light window 115 on both side portions of the light window 115, and can move to the second waste developer storage portion 112 through the developer path (not illustrated).

The waste developer conveying member 113 is rectilinearly-movably mounted in the photosensitive body housing 41. The waste developer conveying member 113, as illustrated by arrows in FIG. 2, moves reciprocatingly in "A" and "B" directions, and conveys the waste developer stored in the first waste developer storage portion 111 and the second waste developer storage portion 112 in the "A" direction.

The waste developer conveying member 113 includes a plurality of conveying ribs 113*a* which are arranged apart from each other. One side surface 113*b* of each conveying rib, which is directed in the waste developer conveying direction (i.e., "A" direction), is formed to be a vertical surface so as to effectively convey the waste developer. The other side surface 113*c* of each conveying rib, which is positioned opposite to the side surface 113*b*, is formed in a slanted surface so as to minimize backward movement of the waste developer when the conveying ribs 113*a* are moved in a direction opposite to the waste developer conveying direction.

As illustrated in FIG. 1, the fusing unit 70 includes a heating roller 71 having a heat source, and a press roller 72 mounted while opposing the heating roller 71. While the printing medium passes between the heating roller 71 and the press roller 72, the image is fused to the printing medium by heat transferred from the heating roller 71 and pressure exerted between the heating roller 71 and the press roller 72.

The printing medium discharge unit 80 includes a discharge roller 81 and a discharge backup roller 82, so as to discharge the printing medium having passed through the fusing unit 70 to the outside of the main body 10.

Figure 3:
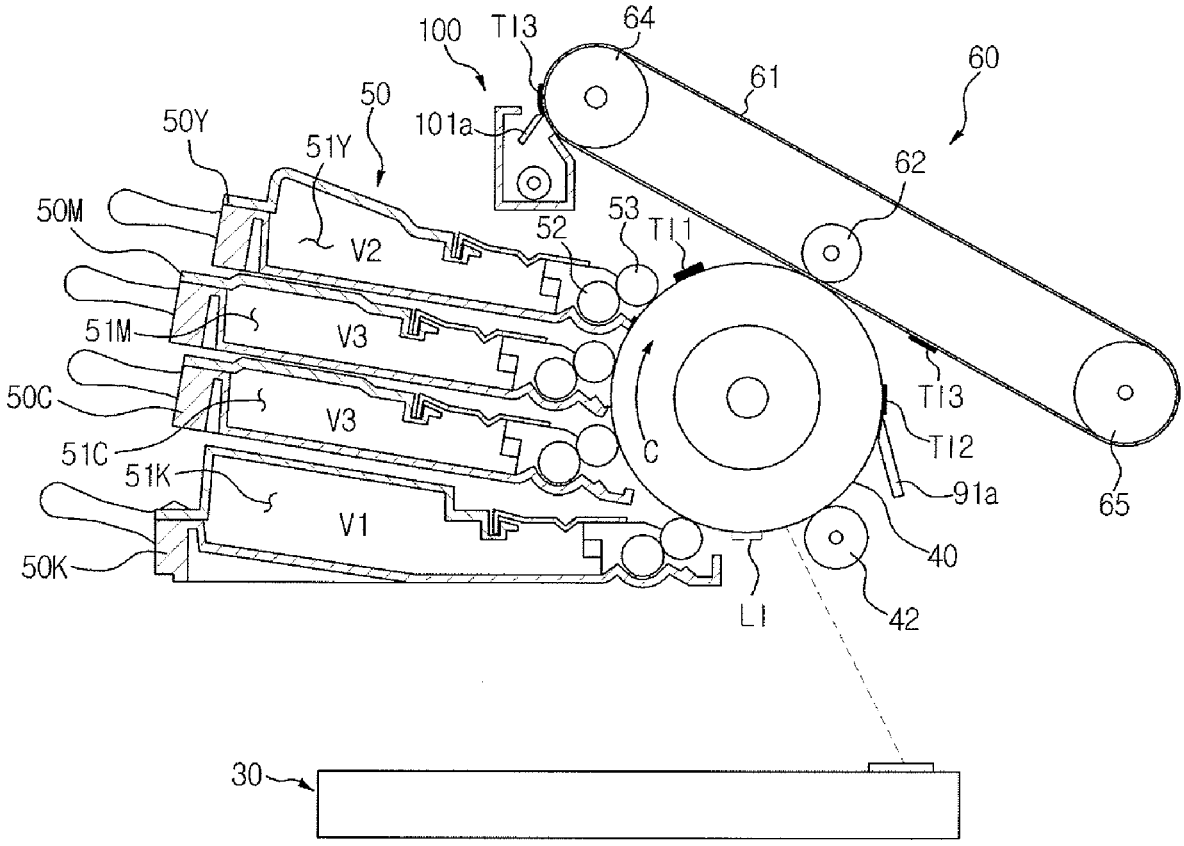
FIG. 3 is a view explaining an operation of the image forming apparatus according to an exemplary embodiment of the present general inventive concept.

The operation of the above-constituted image forming apparatus will now be explained with reference to FIGS. 1 and 3. FIG. 3 is a view illustrating an operation of the image forming apparatus according to an exemplary embodiment of the present general inventive concept.

At the beginning of the printing operation, the surface of the photosensitive body 40 is uniformly charged by the charging roller 42. The laser scanning unit 30 irradiates light corresponding to image information of any one color, e.g., yellow, to the uniformly charged surface of the photosensitive body 40, and an electrostatic latent image corresponding to the yellow image is formed on the photosensitive body 40.

A developing bias is applied to the developing roller 53 of the yellow developing device 50Y, and the yellow developer is attached to the electrostatic latent image. The electrostatic latent image is developed into a yellow developer image on the photosensitive body 40. The developer image is transferred onto the intermediate transfer belt 61 by the first transfer roller 62.

If the yellow developer image corresponding to one page is completely transferred, the laser scanning unit 30 scans light corresponding to image information of another color, e.g., magenta, to the photosensitive body 40 to form an electrostatic latent image corresponding to the magenta image. The magenta developing device 50M supplies the magenta developer to the electrostatic latent image to form a magenta developer image. The magenta developer image formed on the photosensitive body 40 is transferred onto the intermediate transfer belt 61 by the first transfer roller 62, and is overlapped with the yellow developer image which has been already transferred.

Thereafter, if the developer images of cyan and black are sequentially transferred onto the intermediate transfer belt 61 through the same procedures as above, a color image is formed on the intermediate transfer belt 61 by the developer images of yellow, magenta, cyan and black being overlapped. The color image is transferred onto the printing medium passing between the intermediate transfer belt 61 and the second transfer roller 63. Then, the printing medium is discharged to the outside of the main body 10 via the fusing unit 70 and the printing medium discharge unit 80.

In the above image forming process, when the developer image is transferred onto the intermediate transfer belt 61 or the printing medium, a portion of the developer remains on the photosensitive body 40 or the intermediate transfer belt 61. Such a waste developer is removed by the cleaning blades 91*a* and 101*a* which are friction-contacted with the photosensitive body 40 or the intermediate transfer belt 61.

Also when the successive printing operation using a specific printing medium (e.g., an envelope or a label) having a width smaller than a commonly used printing medium (e.g., A4 paper) or using a printing medium having a high transfer efficiency (e.g., an OHP film) is performed, the photosensitive body 40 or the intermediate transfer belt 61 may be damaged due to friction with the cleaning blades 91*a* and 101*a*, or the cleaning blades 91*a* and 101*a* may be turned over. In such a case, during an interval from the printing of one arbitrary page to the printing of a next page, the image forming apparatus 1 performs a lubricating operation of forming a developer image for lubrication on the image carrier.

Referring to FIG. 3, during the lubricating operation of the image forming apparatus 1, the laser scanning unit 30 scans light to the photosensitive body 40, so as to form a band-shaped electrostatic latent image for lubrication (Ll) in an axial direction of the photosensitive body 40.

Subsequently, the yellow developing device 50Y disposed in the most downstream side with respect to the rotational direction (ECU direction) of the photosensitive body 40 supplies the developer to the electrostatic latent image for lubrication, so as to form a developer image for lubrication (Tl1).

As the photosensitive body 40 is rotated, the developer image for lubrication formed on the surface of the photosensitive body 40 reaches the intermediate transfer belt 61. At this time, a portion of the developer image for lubrication is transferred onto the intermediate transfer belt 61 by the first transfer roller 62, and another portion of the developer image for lubrication remains on the photosensitive body 40.

As the photosensitive body 40 is further rotated, a residual developer image for lubrication (Tl2) on the photosensitive body 40 is removed by the cleaning blade 91*a*. At this time, the residual developer image for lubrication (Tl2) on the photosensitive body 40 serves as a lubricant between the photosensitive body 40 and the cleaning blade 91*a*.

Alternatively, as the intermediate transfer belt 61 circulates, a developer image for lubrication (Tl3) transferred onto the intermediate transfer belt 61 is removed by the cleaning blade 101*a*. At this time, the developer image for lubrication (Tl3) transferred onto the intermediate transfer belt 61 serves as a lubricant between the intermediate transfer belt 61 and the cleaning blade 101*a*.

Figure 4:
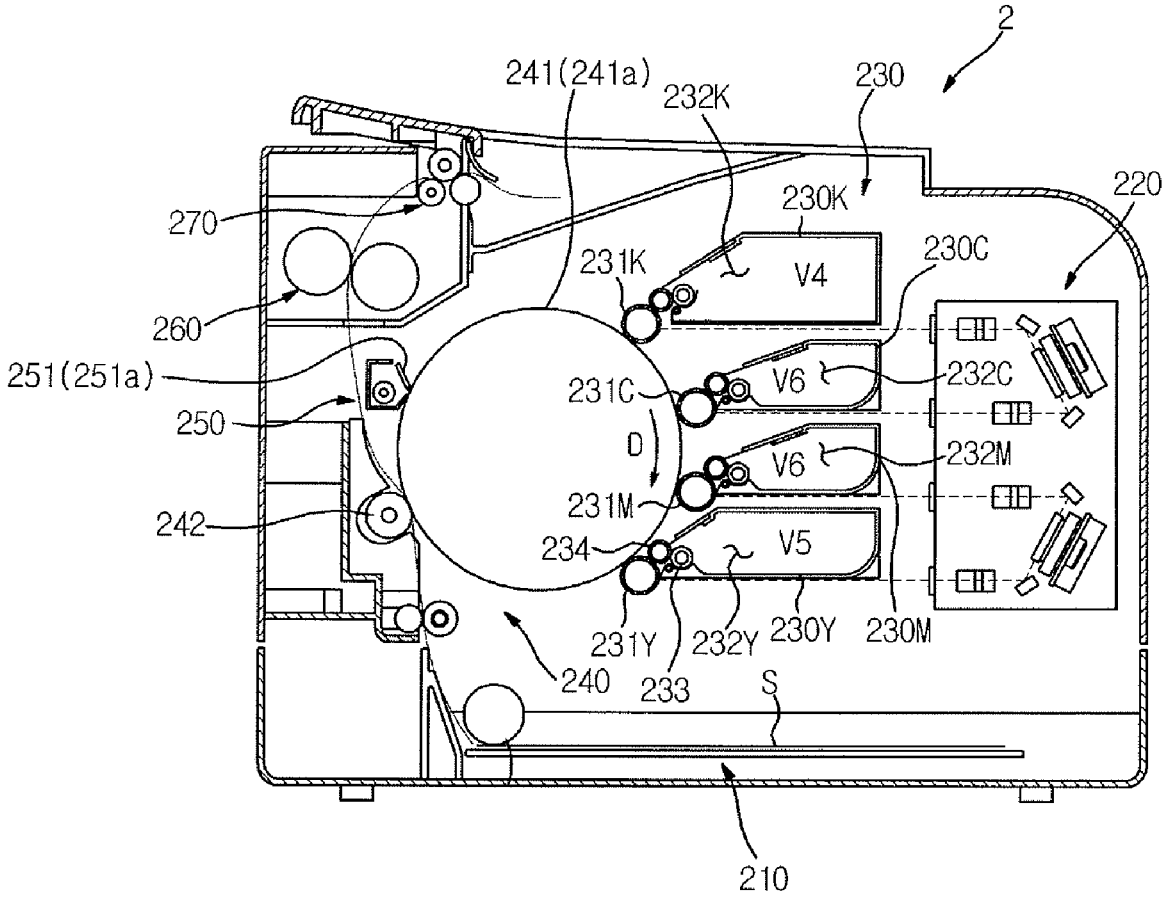
FIG. 4 is a view illustrating an image forming apparatus according to another exemplary embodiment of the present general inventive concept.

FIG. 4 is a view illustrating an image forming apparatus according to another exemplary embodiment of the present general inventive concept. An image forming apparatus of this embodiment includes plural photosensitive bodies.

As illustrated in FIG. 4, an image forming apparatus 2 includes a printing medium feeding unit 210, a laser scanning unit 220, a developing unit 230, a transfer unit 240, a cleaning device 250, a fusing unit 260 and a printing medium discharge unit 270.

The printing medium feeding unit 210 supplies the printing medium S to the transfer unit 240, and the laser scanning unit 220 scans light to photosensitive bodies 231K, 231C, 231M and 231Y, so as to form electrostatic latent images.

The developing unit 230 supplies the developers to the electrostatic latent images formed on the photosensitive bodies 231K, 231C, 231M and 231Y, so as to form visible images.

The developing unit 230 may include four developing devices 230K, 230C, 230M and 230Y, in which developers of different colors from each other, e.g., black (K), cyan (C), magenta (M) and yellow (Y), are respectively stored.

The respective developing devices 230K, 230C, 230M and 230Y include the aforementioned photosensitive bodies 231K, 231C, 231M and 231Y, developer storage portions 232K, 232C, 232M and 232Y to store the developers to be supplied to the photosensitive bodies, supply rollers 233 and developing rollers 234.

The transfer unit 240 includes an intermediate transfer body 241 and a transfer roller 242. The intermediate transfer body 241 serves as an image carrier which holds a developer image formed by the developing unit 230.

When the image forming apparatus performs the printing operation, the developer images formed on the photosensitive bodies 231K, 231C, 231M and 231Y are overlappingly transferred onto the intermediate transfer body 241, and the overlapped color image is transferred onto the printing medium passing between the transfer roller 242 and the intermediate transfer body 241.

The intermediate transfer body 241 may be configured as a transfer drum 241*a* which is rotated while contacting the photosensitive bodies 231K, 231C, 231M and 231Y. As illustrated in FIG. 4, transfer drum 241*a* is used as the intermediate transfer body, however, a belt type intermediate transfer body can be used instead of the transfer drum 241*a*.

The cleaning device 250 includes a cleaning unit 251 which makes friction with the intermediate transfer body 241 to clean the residual waste developer on the intermediate transfer body 241. The cleaning unit 251 may be configured as a cleaning blade 251*a*, one end portion of which is friction-contacted with the surface of the intermediate transfer body 241.

The developing devices 230K, 230C, 230M and 230Y are arranged parallel and adjacent to each other along a rotational direction ("D" direction) of the intermediate transfer body 241. As illustrated in FIG. 4, the black developing device 230K, the cyan developing device 230C, the magenta developing device 230M and the yellow developing device 230Y are arranged in order along the rotational direction of the intermediate transfer body 241, however, the developing devices 230K, 230C, 230M and 230Y are not necessarily arranged in the above-described order. The arrangement order of the developing devices 230K, 230C, 230M and 230Y may be changed as needed.

The developing devices 230K, 230C, 230M and 230Y supply the developers to the intermediate transfer body 241 to form a developer image, when the image forming apparatus 2 performs the printing operation. Also when the image forming apparatus 2 performs the lubricating operation, one of the developing devices 230K, 230C, 230M and 230Y, which is disposed in the most downstream side with respect to the rotational direction of the intermediate transfer body 241, supplies the developer to the intermediate transfer body 241 to form a developer image for lubrication.

When the image forming apparatus 2 performs the lubricating operation, the laser scanning device 220 forms a band-shaped electrostatic latent image for lubrication on the photosensitive body 231Y of the yellow developing device 230Y disposed in the most downstream side, and the yellow developing device 230Y supplies the developer to the electrostatic latent image for lubrication to form a developer image for lubrication on the photosensitive body 231Y. The developer image for lubrication formed on the photosensitive body 231Y is transferred onto the intermediate transfer body 241, and is removed by the cleaning blade 251*a* as the intermediate transfer body 241 is rotated. At this time, the developer image for lubrication serves to reduce friction between the intermediate transfer body 241 and the cleaning blade 251*a*.

If the developing device positioned in the most downstream side with respect to the rotational direction of the intermediate transfer body 241 is used to form the developer image for lubrication, the developing devices 230K, 230C, 230M and 230Y can be operated to start the printing operation immediately after the developer image for lubrication is formed on the intermediate transfer body 241. Therefore, reduction of the printing speed in the successive printing operation can be prevented. Further, the developer image for lubrication formed on the intermediate transfer body 241 is prevented from contaminating the photosensitive bodies 231K, 231C, 231M and 231Y while the developer image passes by the developing devices 230K, 230C, 230M and 230Y.

The black developing device 230K is provided to have the largest developer storage capacity of any developing device. The developing device positioned in the most downstream side with respect to the rotational direction of the intermediate transfer body 241, i.e., the yellow developing device 230Y has the second largest developer storage capacity.

That is, the developer storage portion 232K of the black developing device 230K is formed to have a first volume V4, and the developer storage portion 232Y of the yellow developing device 230Y positioned in the most downstream side with respect to the rotational direction of the intermediate transfer body 241 is formed to have a second volume V5 smaller than the first volume V4. The developer storage portions 232C and 232M of the remaining developing devices 230C and 230M are formed to have a third volume V6 smaller than the second volume V5.

As apparent from the above description, the image forming apparatus according to various embodiments of the present general inventive concept can enhance a user's convenience by designing the developer storage capacity of the developing device forming the developer image for lubrication to be larger than the developer storage capacity of the other developing devices so as to maintain the proper balance between life spans of the developing devices.

Further, since the developing device used for the lubricating operation is disposed in the most downstream side with respect to the rotational direction of the image carrier, reduction of the printing speed and contamination of peripheral components can be prevented.

Although various embodiments of the present general inventive concept have been illustrated and described, it would be appreciated by those skilled in the art that changes may be made in this embodiment without departing from the principles and spirit of the general inventive concept, the scope of which is defined in the claims and their equivalents.

What is claimed is:

1. An image forming apparatus, comprising:

an image carrier; and plural developing devices arranged along a rotational direction of the image carrier to supply a developer to the image carrier, wherein the plural developing devices include a first developing device having a largest developer storage capacity, and a second developing device disposed in a most downstream side with respect to the rotational direction of the image carrier and having a developer storage capacity smaller than the developer storage capacity of the first developing device and larger than a developer storage capacity of remaining developing devices.

2. The image forming apparatus according to claim 1, further comprising:

a cleaning unit to remove a residual developer on the image carrier by making friction with the image carrier, wherein the second developing device supplies a developer to the image carrier to reduce friction between the image carrier and the cleaning unit.

3. The image forming apparatus according to claim 1, further comprising:

a laser scanning unit to scan light to the image carrier, wherein the laser scanning unit forms an electrostatic latent image for lubrication on a surface of the image carrier, and the second developing device supplies a developer to the electrostatic latent image for lubrication.

4. The image forming apparatus according to claim 1, wherein the developing devices are arranged parallel and adjacent to each other.

5. The image forming apparatus according to claim 1, wherein the image carrier includes a photosensitive body having a surface on which an electrostatic latent image and a developer image are formed.

6. The image forming apparatus according to claim 1, wherein the plural developing devices respectively include photosensitive bodies having respective surfaces on which electrostatic latent images and developer images are formed, and the image carrier includes an intermediate transfer body to hold a developer image transferred from the respective photosensitive bodies.

7. The image forming apparatus according to claim 1, wherein the first developing device stores a black developer.

8. The image forming apparatus according to claim 1, wherein the second developing device stores a yellow developer.

9. An image forming apparatus, comprising:

a photosensitive body;

a laser scanning unit to form an electrostatic latent image by scanning light to the photosensitive body; and plural developing devices arranged along a rotational direction of the photosensitive body, wherein the plural developing devices include a first developing device including a first developer storage portion having a first volume, a second developing device including a second developer storage portion having a second volume smaller than the first volume, and at least one third developing device including a third developer storage portion having a third volume smaller than the second volume, and the second developing device is disposed in a most downstream side with respect to the rotational direction of the photosensitive body.

10. The image forming apparatus according to claim 9, wherein the first developing device, the second developing device and the at least one third developing device are arranged parallel and adjacent to each other.

11. The image forming apparatus according to claim 9, further comprising:

a cleaning unit to remove a residual developer on the photosensitive body by making friction with the photosensitive body, wherein the laser scanning unit forms an electrostatic latent image for lubrication on the photosensitive body, and the second developing device supplies a developer to the electrostatic latent image for lubrication to form a developer image for lubrication, so as to reduce friction between the photosensitive body and the cleaning unit.

12. The image forming apparatus according to claim 11, further comprising:

an intermediate transfer belt to hold an image transferred from the photosensitive body; and a cleaning unit to remove a residual developer on the intermediate transfer belt by making friction with the intermediate transfer belt.

13. An image forming apparatus, comprising:

plural developing devices respectively including photosensitive bodies and supplying developers to the respective photosensitive bodies;

a laser scanning unit to form electrostatic latent images by scanning light to the respective photosensitive bodies; and an intermediate transfer body to hold images transferred from the photosensitive bodies, wherein the plural developing devices include a first developing device including a first developer storage portion having a first volume, a second developing device including a second developer storage portion having a second volume smaller than the first volume, and at least one third developing device including a third developer storage portion having a third volume smaller than the second volume, and the second developing device is disposed in a most downstream side with respect to a rotational direction of the intermediate transfer body.

14. The image forming apparatus according to claim 13, wherein the first developing device, the second developing device and the at least one third developing device are arranged parallel and adjacent to each other along the rotational direction of the intermediate transfer body.

15. The image forming apparatus according to claim 13, further comprising:

a cleaning unit to remove a residual developer on the intermediate transfer body by making friction with the intermediate transfer body, wherein the laser scanning unit forms an electrostatic latent image for lubrication on the photosensitive body of the second developing device, and the second developing device supplies a developer to the electrostatic latent image for lubrication to form a developer image for lubrication, so as to reduce friction between the intermediate transfer body and the cleaning unit.

16. A developing unit usable with an image forming apparatus to supply a developer to a rotating image carrier, the developer unit comprising:

plural developing devices arranged parallel and adjacent to each other along a rotational direction of the image carrier, the plural developing devices include:

a first developing device having a largest first developer storage capacity; and a second developing device disposed in a most downstream side with respect to the rotational direction of the image carrier and having a second developer storage capacity smaller than the first developer storage capacity of the first developing device and larger than respective developer storage capacities of remaining developing devices.

17. A developing device usable with an image forming apparatus, the developing device comprising:

a developer storage portion to store and supply a developer of a first color to the image carrier and having a developer storage capacity smaller than a first developer storage capacity of a first developing device provided to supply a black developer to the image carrier and larger than a second developer storage capacity of a second developing device provided to supply a developer, of a second color to the image carrier, wherein the developing device is disposed in a most downstream side of developing devices arranged parallel and adjacent to each other along a rotational direction of an image carrier.

18. A developing device usable with an image forming apparatus, the developing device comprising:

a developer storage portion to store a black developer, and is disposed in an upper stream side than a first developing device of the developing devices arranged parallel and adjacent to each other along a rotational direction of an image carrier, the first developing device provided to supply a developer of a first color to the image carrier, and the developing device having a developer storage capacity larger than a second developer storage capacity of a second developing device disposed in a most downstream side along the rotational direction of the image carrier, the second developer storage capacity of the second developing device being larger than the first developer storage capacity of the first developing device.

19. A developing device usable with an image forming apparatus, the developing device comprising:

a developer storage capacity smaller than a first developer storage capacity of a first developing device of developing devices arranged parallel and adjacent to each other along a rotational direction of an image carrier, the first developing device being provided to supply a black developer to the image carrier, and smaller than a second developer storage capacity of a second developing device disposed in a most downstream side along the rotational direction of the image carrier, wherein the developing device is disposed between the first developing device and the second developing device along the rotational direction of the image carrier.

20. An image forming apparatus, comprising:

a photosensitive body to receive an electrostatic latent image;

a laser scanning unit to form the electrostatic latent image on the photosensitive body;

a cleaning unit to remove a residual developer on the photosensitive body; and a plurality of developer devices having respective developer storage capacities, one of the developer devices to supply a developer to the electrostatic latent image to form a developer image for lubrication to reduce friction between the photosensitive body and the cleaning unit, wherein a respective developer storage capacity of the one developer device is greater than an other respective storage capacity of at least one of an other developer device and the respective developer storage capacity of the one developer device is smaller than an other respective storage capacity of at least one of an other developer device.

21. The image forming apparatus according to claim 20, wherein the one developer device stores yellow developer.

22. An image forming apparatus, comprising:

an image carrier; and a plurality of developing devices arranged along a portion of the image carrier, a developing device among the plurality of developing devices which is furthest down stream of a rotation direction of the image carrier having a larger storage capacity than other ones of the plurality of developing devices, wherein the developing device furthest downstream of the rotation direction of the image carrier contains a developer which provides a lubrication to the image carrier and a developer device among the plurality of developing devices which is furthest upstream of the rotation direction of the image carrier has a larger storage capacity than the developing device furthest downstream of the rotation direction of the image carrier to store a most commonly used developer without developers stored in the other developing devices.

* * * * *